US008773031B2

(12) United States Patent
Sadwick et al.

(10) Patent No.: US 8,773,031 B2
(45) Date of Patent: Jul. 8, 2014

(54) DIMMABLE TIMER-BASED LED POWER SUPPLY

(75) Inventors: Laurence P. Sadwick, Salt Lake City, UT (US); William B. Sackett, Sandy, UT (US); Michael D. Brady, West Valley City, UT (US)

(73) Assignee: InnoSys, Inc., Salt Lake City, UT (US)

( * ) Notice: Subject to any disclaimer, the term of this patent is extended or adjusted under 35 U.S.C. 154(b) by 35 days.

(21) Appl. No.: 13/299,912

(22) Filed: Nov. 18, 2011

(65) Prior Publication Data

US 2012/0299500 A1 Nov. 29, 2012

Related U.S. Application Data

(60) Provisional application No. 61/415,913, filed on Nov. 22, 2010.

(51) Int. Cl.
*H05B 37/02* (2006.01)

(52) U.S. Cl.
USPC ..... 315/224; 315/225; 315/307

(58) Field of Classification Search
USPC ..... 315/209 R, 224, 225, 246, 297, 294, 307
See application file for complete search history.

(56) References Cited

U.S. PATENT DOCUMENTS

| | | | |
|---|---|---|---|
| 4,629,944 | A | 12/1986 | Maytum et al. |
| 4,914,356 | A | 4/1990 | Cockram |
| 5,404,080 | A | 4/1995 | Quazi |
| 5,463,280 | A | 10/1995 | Johnson |
| 5,581,158 | A | 12/1996 | Quazi |
| 5,734,564 | A | 3/1998 | Brkovic |
| 6,081,075 | A | 6/2000 | Littlefield |
| 6,295,217 | B1 | 9/2001 | Yang et al. |
| 6,392,368 | B1 | 5/2002 | Deller et al. |
| 6,462,485 | B1 | 10/2002 | Kimball |
| 6,577,512 | B2 | 6/2003 | Tripathi et al. |
| 6,853,151 | B2 | 2/2005 | Leong |
| 6,927,989 | B2 | 8/2005 | Fukumoto |
| 6,936,968 | B2 | 8/2005 | Cross et al. |
| 6,965,205 | B2 | 11/2005 | Piepgras et al. |
| 7,151,246 | B2 | 12/2006 | Fein et al. |
| 7,151,345 | B2 | 12/2006 | Sanchez |

(Continued)

FOREIGN PATENT DOCUMENTS

| | | | |
|---|---|---|---|
| WO | WO03/096761 | A1 | 11/2003 |
| WO | WO2008/137460 | A2 | 11/2008 |

OTHER PUBLICATIONS

Supplemental European Search Report re EP10762548, Dec. 18, 2012.

(Continued)

*Primary Examiner* — Don Le
(74) *Attorney, Agent, or Firm* — Hamilton DeSanctis & Cha

(57) ABSTRACT

Various embodiments of a dimmable power supply are disclosed herein. For example, some embodiments provide a dimmable power supply including an input current path, a switch in the input current path, an energy storage device connected to the input current path, a load output connected to the energy storage device, and a timer-based variable pulse generator connected to a control input of the switch. The timer-based variable pulse generator is adapted to generate a stream of pulses having a variable on-time and off-time. The dimmable power supply is adapted to vary the on-time and off-time to control a current at the load output.

19 Claims, 13 Drawing Sheets

(56) References Cited

U.S. PATENT DOCUMENTS

| | | | | |
|---|---|---|---|---|
| 7,161,313 | B2 | 1/2007 | Piepgras et al. | |
| 7,178,941 | B2 | 2/2007 | Roberge et al. | |
| 7,183,724 | B2 | 2/2007 | Ball | |
| 7,202,613 | B2 | 4/2007 | Morgan et al. | |
| 7,233,115 | B2 | 6/2007 | Lys | |
| 7,256,554 | B2 | 8/2007 | Lys | |
| 7,262,559 | B2 | 8/2007 | Tripathi et al. | |
| 7,276,861 | B1 | 10/2007 | Shteynberg | |
| 7,295,176 | B2 | 11/2007 | Yang | |
| 7,298,095 | B2 | 11/2007 | Nukisato et al. | |
| 7,358,706 | B2 | 4/2008 | Lys | |
| 7,378,805 | B2 | 5/2008 | Oh et al. | |
| 7,441,922 | B2 | 10/2008 | Huang et al. | |
| 7,459,864 | B2 | 12/2008 | Lys | |
| 7,478,941 | B2 | 1/2009 | Wu et al. | |
| 7,511,437 | B2 | 3/2009 | Lys et al. | |
| 7,557,519 | B2 | 7/2009 | Kranz | |
| 7,759,881 | B1 * | 7/2010 | Melanson | 315/307 |
| 8,022,634 | B2 | 9/2011 | Greenfeld | |
| 8,115,421 | B2 | 2/2012 | Mishima et al. | |
| 8,148,907 | B2 | 4/2012 | Sadwick | |
| 8,203,445 | B2 | 6/2012 | Recker et al. | |
| 8,405,319 | B2 | 3/2013 | Sadwick | |
| 2003/0066897 | A1 | 4/2003 | Carner et al. | |
| 2003/0085669 | A1 | 5/2003 | Pak | |
| 2005/0265035 | A1 | 12/2005 | Brass et al. | |
| 2006/0170373 | A1 * | 8/2006 | Yang | 315/209 R |
| 2006/0220595 | A1 | 10/2006 | Lu | |
| 2007/0025119 | A1 | 2/2007 | Chang-Jien | |
| 2007/0114986 | A1 | 5/2007 | Yoshii | |
| 2007/0228999 | A1 | 10/2007 | Kit | |
| 2008/0067953 | A1 | 3/2008 | Kranz | |
| 2008/0081423 | A1 | 4/2008 | Sadwick et al. | |
| 2008/0094837 | A1 | 4/2008 | Dobbins et al. | |
| 2008/0284346 | A1 | 11/2008 | Lee | |
| 2008/0290814 | A1 | 11/2008 | Leong | |
| 2009/0009994 | A1 | 1/2009 | Wu et al. | |
| 2009/0085501 | A1 | 4/2009 | Cross | |
| 2010/0026208 | A1 | 2/2010 | Shteynberg | |
| 2010/0033095 | A1 | 2/2010 | Sadwick | |
| 2010/0060204 | A1 | 3/2010 | Ohtake et al. | |
| 2010/0176743 | A1 | 7/2010 | Lee et al. | |
| 2010/0194296 | A1 | 8/2010 | Park | |
| 2010/0244696 | A1 | 9/2010 | Kim | |
| 2011/0115407 | A1 * | 5/2011 | Wibben et al. | 315/294 |
| 2011/0169426 | A1 | 7/2011 | Sadwick | |
| 2011/0260619 | A1 | 10/2011 | Sadwick | |
| 2012/0038292 | A1 * | 2/2012 | Kuo et al. | 315/297 |
| 2012/0043893 | A1 | 2/2012 | Sadwick | |
| 2012/0242246 | A1 * | 9/2012 | Naruo | 315/283 |
| 2012/0249000 | A1 * | 10/2012 | Kawai et al. | 315/200 R |

OTHER PUBLICATIONS

U.S. Appl. No. 13/098,768, Unpublished (filed May 2, 2011) (Laurence P. Sadwick).

U.S. Appl. No. 13/073,959, Unpublished (filed Mar. 28, 2011) (Laurence P. Sadwick).

Written opinion of the international searching authority re PCT/US2010/030644, Oct. 20, 2011.

* cited by examiner

DIMMABLE TIMER-BASED LED POWER SUPPLY

BACKGROUND

Electricity is generated and distributed in alternating current (AC) form, wherein the voltage varies sinusoidally between a positive and a negative value. However, many electrical devices require a direct current (DC) supply of electricity having a constant voltage level, or at least a supply that remains positive even if the level is allowed to vary to some extent. For example, light emitting diodes (LEDs) and similar devices such as organic light emitting diodes (OLEDs) are being increasingly considered for use as light sources in residential, commercial and municipal applications. However, in general, unlike incandescent light sources, LEDs and OLEDs cannot be powered directly from an AC power supply unless, for example, the LEDs are configured in some back to back formation. Electrical current flows through an individual LED easily in only one direction, and if a negative voltage which exceeds the reverse breakdown voltage of the LED is applied, the LED can be damaged or destroyed. Furthermore, the standard, nominal residential voltage level is typically something like 120 V or 240 V, both of which are higher than may be desired for a high efficiency LED light. Some conversion of the available power may therefore be necessary or highly desired with loads such as an LED light.

In one type of commonly used power supply for loads such as an LED, an incoming AC voltage is connected to the load only during certain portions of the sinusoidal waveform. For example, a fraction of each half cycle of the waveform may be used by connecting the incoming AC voltage to the load each time the incoming voltage rises to a predetermined level or reaches a predetermined phase and by disconnecting the incoming AC voltage from the load each time the incoming voltage again falls to zero. In this manner, a positive but reduced voltage may be provided to the load. This type of conversion scheme is often controlled so that a constant current is provided to the load even if the incoming AC voltage varies. However, if this type of power supply with current control is used in an LED light fixture or lamp, a conventional dimmer is often ineffective. For many LED power supplies, the power supply will attempt to maintain the constant current through the LED despite a drop in the incoming voltage by, for example, increasing the on-time during each cycle of the incoming AC wave.

SUMMARY

Various embodiments of a dimmable power supply are disclosed herein. For example, some embodiments provide a dimmable power supply including an input current path, a switch in the input current path, an energy storage device connected to the input current path, a load output connected to the energy storage device, and a timer-based variable pulse generator connected to a control input of the switch. The timer-based variable pulse generator is adapted to generate a stream of pulses having a variable on-time and off-time. The dimmable power supply is adapted to vary the on-time and off-time to control a current at the load output. The present invention is also suitable as a DC to DC converter and for other power supply and converter, driver, module, etc. applications. Nothing in this document should be viewed as limiting in terms of input power/voltage/current source with both AC to DC and DC to DC as well as other combinations and embodiments to be included and covered in this present invention document.

In various embodiments of the dimmable power supply, the timer-based variable pulse generator comprises a 555 timer circuit or a power factor correction circuit.

In some embodiments, the on-time of the pulses is controlled at least in part based on the current at the load output. This may be accomplished using a feedback circuit, wherein the on-time of the pulses is controlled at least in part based on the feedback circuit.

Some embodiments include a bias power supply that powers the timer-based variable pulse generator which is powered by the bias power supply, and the on-time of the pulses is controlled at least in part based on the voltage level from the bias power supply.

In some embodiments, the on-time of the pulses is controlled based on a number of control signals, including an indication of input current level, load output current, and the voltage of a bias power supply powering the timer-based variable pulse generator.

Some embodiments include an inverter connected between the 555 timer circuit and the switch.

In some embodiments, the on-time is controlled at least in part on a value of an external resistor connected to the 555 timer circuit. The value of the external resistor may be changed using a transistor, which in some embodiments is powered only during the on-time. The value of the external resistor may be changed, for example, by connecting a second resistor in parallel with the resistor. In some embodiments the external resistor is a programmable resistor, and the value of the external resistor is changed by changing the state of the programmable resistor. The change of the resistance can be accommodated and accomplished in a number of ways including ways that employ transistors, optocouplers, optoisolators, variable resistor, potentiometer, diodes, other types of diodes including Zener and/or avalanche diodes, triacs, etc.

Some embodiments include a soft start circuit connected to the 555 timer and adapted to reduce the on-time and/or increase the off-time during a startup period of the 555 timer. The soft start circuit may, as an example but not limiting in any way or form, include a transistor that is turned on based on the voltage of the bias power supply that powers the 555 timer. As an example, the transistor adjusts an external resistance to set the on-time of the 555 timer.

In some embodiments, power consumption is reduced by powering at least one active circuit element loop in a feedback loop only during the on-time.

Some embodiments include a load current feedback circuit connected between the load output and the timer-based variable pulse generator to control the on-time. The load current feedback circuit may include a number of different time constants to dither the frequency. The load current feedback circuit may, as an example but not limiting in any way or form, include a number of operational amplifiers, each connected to the load output and to a reference voltage, each having a different time constant.

Other embodiments provide a method of controlling a load current, including generating a stream of pulses in a timer-based variable pulse generator to turn on and off a switch in an input current path, creating a switched input current path. The method also includes providing a load current from the switched input current path, measuring the load current, and reducing the on-time of a timer in the timer-based variable pulse generator if the load current exceeds a current threshold.

This summary provides only a general outline of some particular embodiments and should not be viewed as limiting in any way or form. Many other objects, features, advantages and other embodiments will become more fully apparent from the following detailed description, the appended claims and the accompanying drawings.

BRIEF DESCRIPTION OF THE DRAWINGS

A further understanding of the various embodiments may be realized by reference to the figures which are described in remaining portions of the specification. In the figures, like reference numerals may be used throughout several drawings to refer to similar components.

DESCRIPTION

The drawings and description, in general, disclose various embodiments of a dimmable timer-based power supply for loads such as an LED or array of LEDs. These embodiments are examples of the present invention and should not be construed as limiting in any way or form for the present invention disclosed. The dimmable timer-based power supply may use either an AC or DC input, with a varying or constant voltage level. The current through the load from the dimmable power supply may be adjusted using conventional or other types of dimmers in the power supply line upstream from the dimmable timer-based power supply. The power supply may be used, for example, with a dimmer containing a TRIAC, but is not limited to this use. The system may also be used to improve performance of a dimmer containing a silicon-controlled rectifier (SCR). Thus, the term "dimmable" is used herein to indicate that input voltage of the dimmable timer-based power supply may be varied to dim a load or otherwise reduce the load current, without the control system in the dimmable timer-based power supply opposing the resulting change to the load current and keeping the load current constant. Various embodiments of the dimmable timer-based power supply may, in addition to being externally dimmable, be internally dimmable by including dimming elements within the power supply. In these embodiments, the load current may be adjusted by controlling the input voltage of the power supply using an external dimmer and by controlling the internal dimming elements within the power supply. The system is also operational when no dimmer is used. The present invention can also be controlled remotely using wireless, wired, powerline, etc methods, techniques, approaches, standards, etc.

Figure 1:
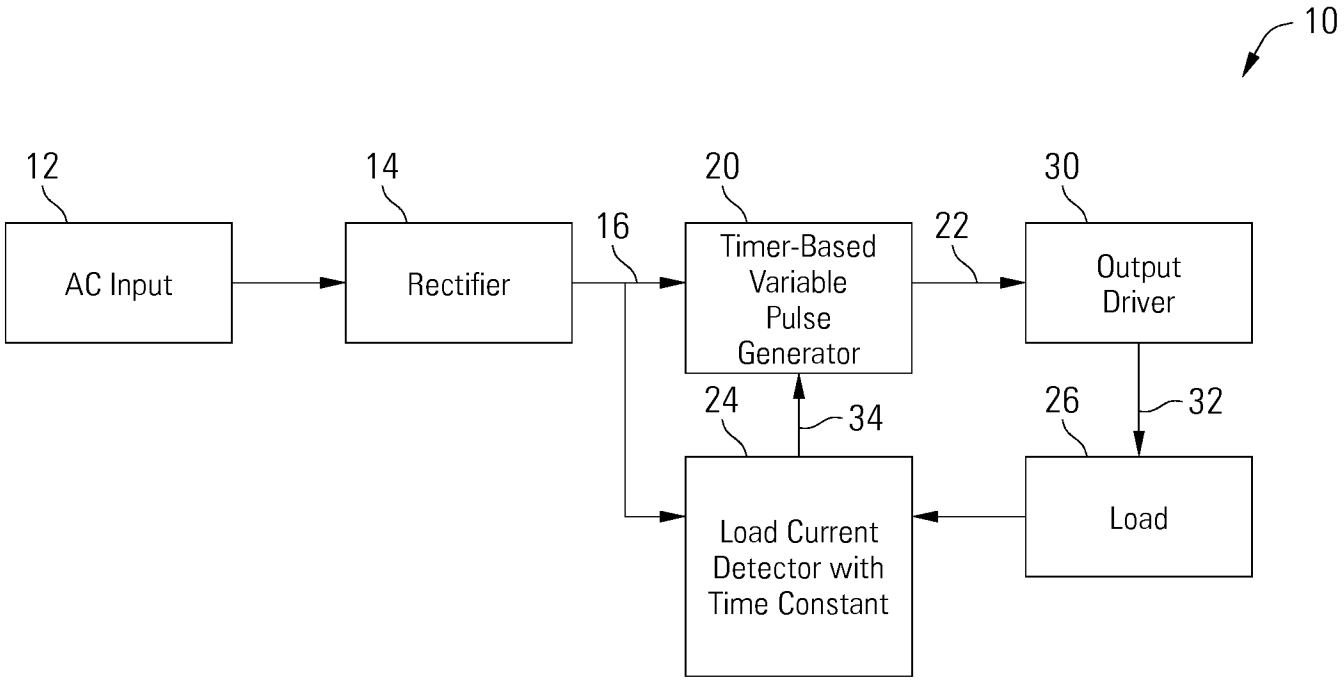
FIG. 1 depicts a block diagram of a timer-based dimmable power supply in accordance with some embodiments.

Referring now to FIG. 1, a block diagram of an embodiment of a dimmable timer power supply 10 is shown. In this embodiment, the power supply 10 is powered by an AC input 12, for example by a 50 or 60 Hz sinusoidal waveform of 100 to 120 V or 200 to 240 V RMS such as that supplied to residences by municipal electric power companies typically at 50 or 60 Hz. It is important to note, however, that the power supply 10 is not limited to any particular power input. Furthermore, the voltage applied to the AC input 12 may be externally controlled, such as in an external dimmer (not shown) that reduces the voltage. The AC input 12 is connected to a rectifier 14 to rectify and invert any negative voltage component from the AC input 12. Although the rectifier 14 may filter and smooth the power output 16 if desired to produce a DC signal, this is not necessary and the power output 16 may be a series of rectified half sinusoidal waves at a frequency double that at the AC input 12, for example 100 to 120 Hz. A timer-based variable pulse generator 20 is powered by the power output 16 from the AC input 12 and rectifier 14 to generate a train of pulses at an output 22. The timer-based variable pulse generator 20 may comprise any timer device or timer circuit now known or that may be developed in the future to generate a train of pulses of any desired shape, such as a 555 timer. The 555 timer included in various embodiments may comprise an integrated circuit 555 timer, or may comprise analogous circuits or executable program code that implement a similar function to an integrated circuit 555 timer, or may use multiple 555 timers such as a 556 dual 555 timer IC. The present invention is not restricted to 555 timers especially those made using bipolar junction transistors and, also, including those using metal oxide semiconductor (MOS) devices and related technology including CMOS such as 7555 ICs, etc.

The pulse width of the train of pulses is controlled by a load current detector 24 with a time constant based on a current level through a load 26. Various implementations of pulse width control including pulse width modulation (PWM) by frequency, analog and/or digital control may be used to realize the pulse width control. Other features such as soft start, delayed start, instant on operation, etc. may also be included if deemed desirable, needed, and/or useful. An output driver 30 produces a current 32 through the load 26, with the current level adjusted by the pulse width at the output 22 of the variable pulse generator 20. The current 32 through the load 26 is monitored by the load current detector 24. The current monitoring performed by the load current detector 24 is done with a time constant that includes information about voltage changes at the power output 16 of the rectifier 14 typically slower than or on the order of a waveform cycle at the power output 16, but not typically faster than changes at the power output 16 or voltage changes at the output 22 of the variable pulse generator 20. The control signal 34 from the load current detector 24 to the variable pulse generator 20 thus varies with slower changes in the power output 16 of the rectifier 14, but not with the incoming rectified AC waveform or with changes at the output 22 of the variable pulse generator 20 due to the pulses themselves. In one particular embodiment, the load current detector 24 includes one or more low pass filters to implement the time constant used in the load current detection. The time constant may be established by a number of suitable devices and circuits, and the power supply 10 is not limited to any particular device or circuit. For example, the time constant may be established using RC circuits arranged in the load current detector 24 to form low pass filters, or with other types of passive or active filtering circuits. The load 26 may be any desired type of load, such as a light emitting diode (LED) or an array of LEDs arranged in any configuration. For example, an array of LEDs may be connected in series or in parallel or in any desired combination of the two. The load 26 may also be an organic light emitting diode (OLED) in any desired quantity and configuration. The load 26 may also be a combination of different devices if desired, and is not limited to the examples set forth herein. Hereinafter, the term LED is used generically to refer to all types of LEDs including OLEDs and is to be interpreted as a non-limiting example of a load. The present invention may also be realized without the use of feedback time constants. The present invention may also be realized without feedback circuits with some reduction in the protection of the driver for use with LEDs and other light sources.

The inventive concepts disclosed herein may be applied in a wide range of different embodiments, with several examples given herein. Other embodiments may benefit from a timer-based variable pulse generator, such as those disclosed in U.S. patent application Ser. No. 12/422,258 entitled "Dimmable Power Supply", filed Apr. 11, 2009, the entirety of which is incorporated herein by reference for all purposes.

Figure 2:
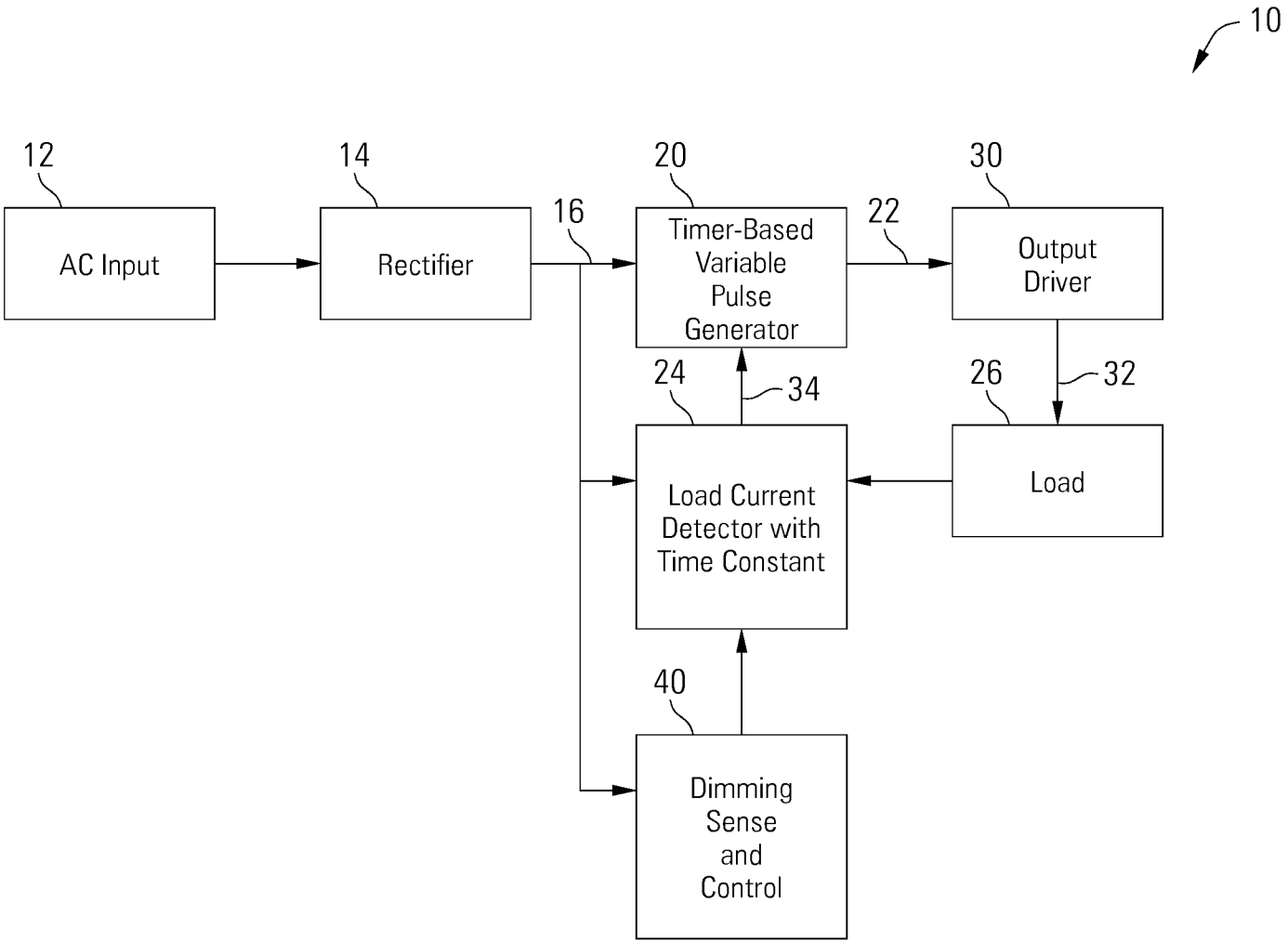
FIG. 2 depicts a block diagram of a timer-based dimmable power supply with internal dimming.

Referring now to FIG. 2, some embodiments of the dimmable timer-based power supply 10 may also include an internal dimmer 40 adapted to adjustably reduce the current 32 through the load 26 by narrowing the pulse width at the output 22 of the timer-based variable pulse generator 20. This may be accomplished in a number of ways, for example by adjusting a reference voltage or current in the load current detector 24 that is based on the power output 16 from the rectifier 14. The internal dimmer 40 may also adjust the level of a feedback voltage or current from the load 26 to narrow the pulse width and reduce the load current. The internal dimmer can also be based on pulse width modulation (PWM) and related methods, techniques and technologies. In addition, the pulse width can be essentially left constant or unchanged, and the duty cycle, for example, using a phase angle or phase cut dimmer such as a triac or other types of forward or reverse phase dimmers, the on time of the triac or other type of dimmer can be directly used to set the dimming level of the present invention without the need of additional circuitry or detectors to set the dimming level. In addition, remote dimming by various wired and wireless means including powerline, infrared, radio frequency (RF), WiFi, Bluetooth, Zigbee and any other types wireless methods, techniques, frequencies, etc. internet and web based, cellular phones and personal digital assistants, computers and electronic book readers, etc. can also be included and enabled in the present invention to control the present timer driver to, for example, remotely dim and/or turn of the output of the present invention.

Figure 3:
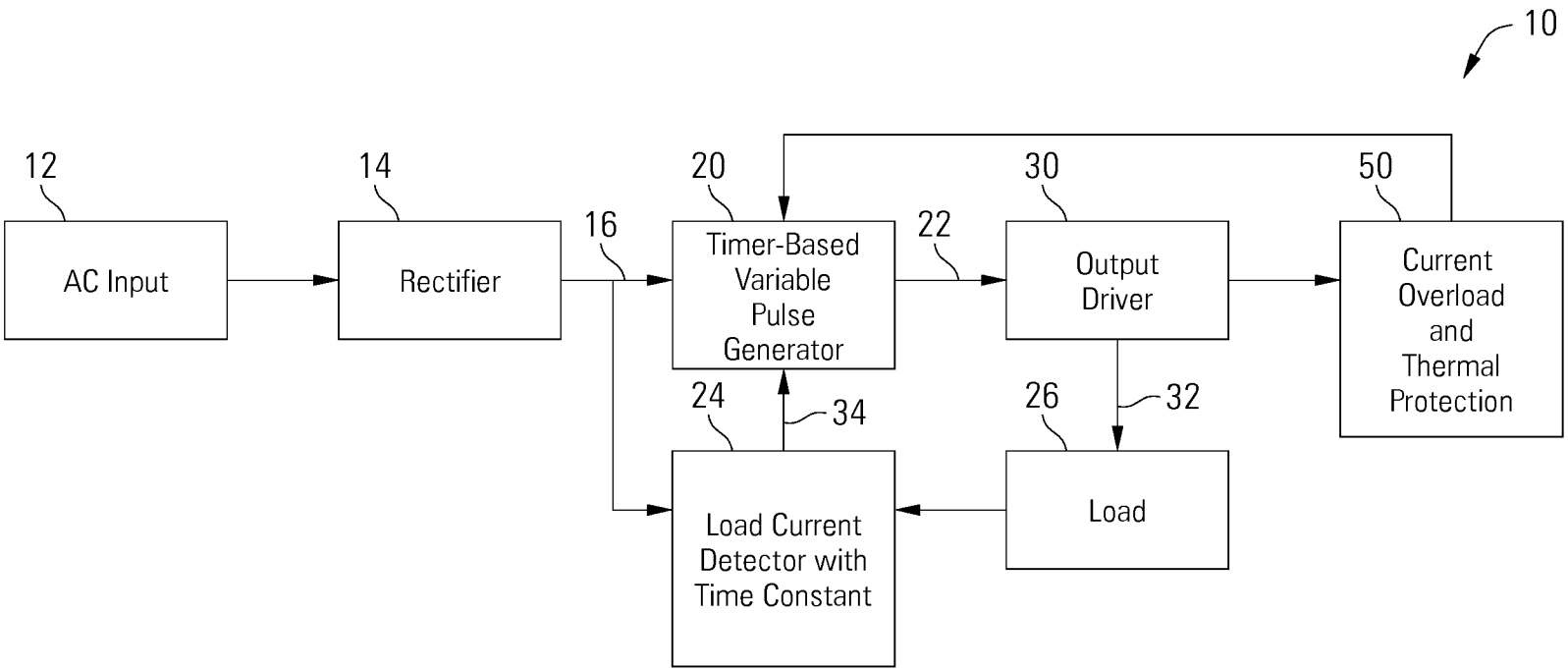
FIG. 3 depicts a block diagram of a timer-based dimmable power supply with current overload and thermal protection.

Some embodiments of the dimmable timer-based power supply 10 may include current overload protection and/or thermal protection 50, as illustrated in FIG. 3. As an example, the current overload protection 50 measures the current through the dimmable power supply 10 and narrows or turns off the pulses at the output 22 of the timer-based variable pulse generator 20 if the current exceeds a threshold value. The current detection for the current overload protection 50 may be adapted as desired to measure instantaneous current, average current, or any other measurement desired and at any desired location in the power supply 10. Either or both active or passive measurement and detection can be used. A simple example of passive detection would be a resistor capacitor (RC) network used, for example, as a RC filter. Notch and bandpass filters can also be used with the present invention. Analog and/or digital control or both analog and digital control can be used in various embodiments of the present invention. Thermal protection 50 may also be included to narrow or turn off the pulses at the output 22 of the timer-based variable pulse generator 20 if the temperature in the power supply 10 becomes excessive, thereby reducing the power through the power supply 10 and allowing the power supply 10 to cool. The thermal protection may also be designed and implemented such that at a prescribed temperature, the pulses are turned off which effectively disables the power supply 10 and turns off the output to the load. The temperature sensor can be any type of temperature sensitive element including semiconductors such as diodes, transistors, etc. and/or thermocouples, thermistors, bimetallic elements and switches, etc. Various approaches can be used to re-enable the supply including, but not limited to automatically resetting when the temperature has decreased, hiccup mode, manual reset, automatic recovery, override, etc.

Figure 4:
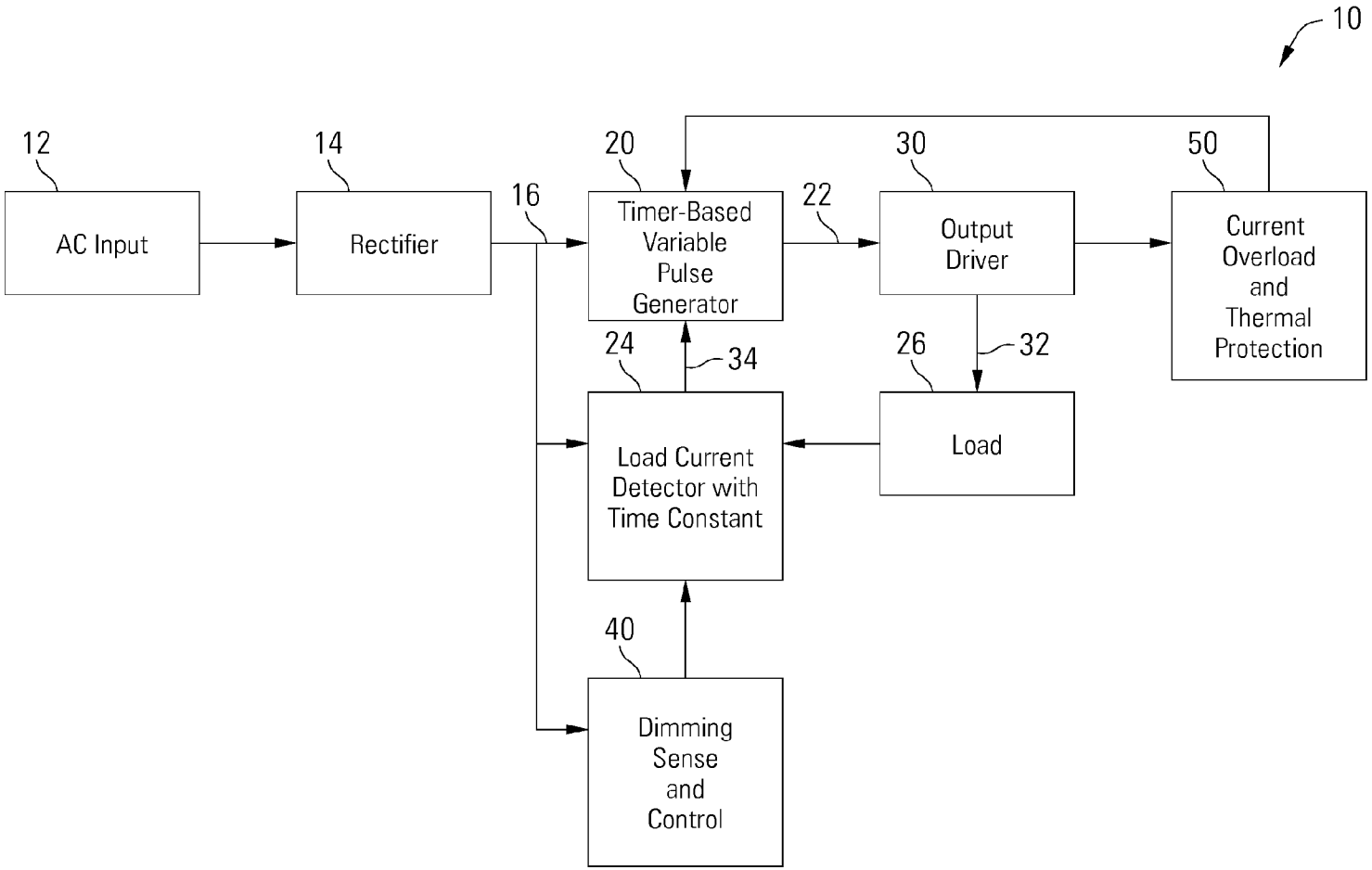
FIG. 4 depicts a block diagram of a timer-based dimmable power supply with internal dimming and current overload and thermal protection.

Elements of the various embodiments disclosed herein may be included or omitted as desired. For example, in the block diagram of FIG. 4, a dimmable timer-based power supply 10 is disclosed that includes both the internal dimmer 40 and the current overload protection and thermal protection 50.

Figure 5:
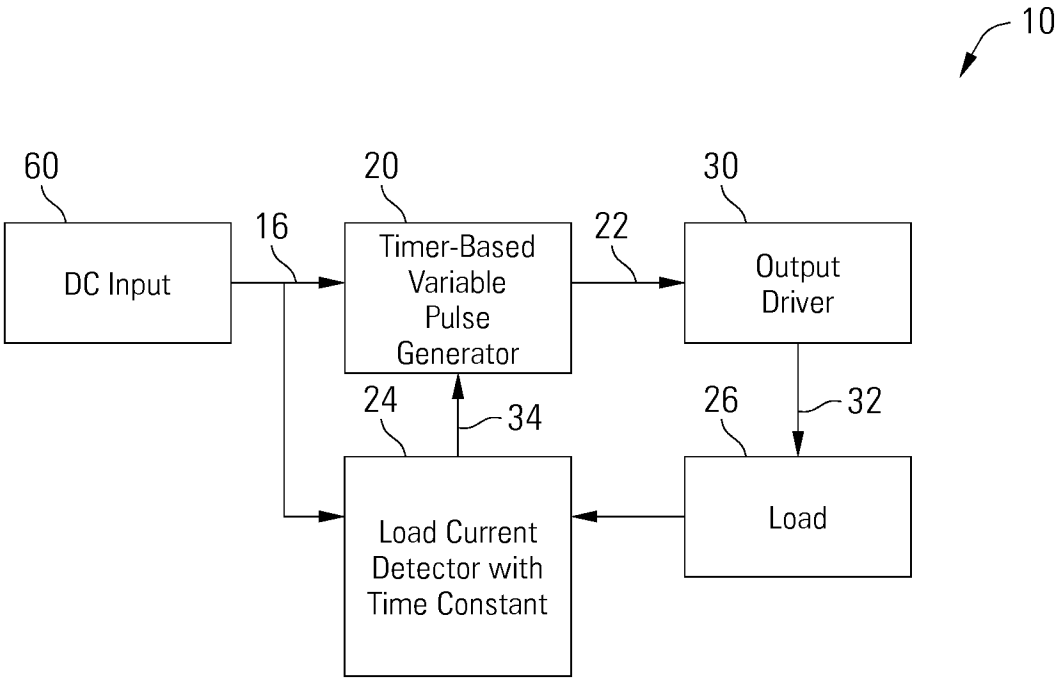
FIG. 5 depicts a block diagram of a timer-based dimmable power supply with a DC input.

As discussed above, the dimmable timer-based power supply 10 may be powered by any suitable power source, such as the AC input 12 and rectifier 14 of FIG. 1, or a DC input 60 as illustrated in FIG. 5. Time constants in the power supply 10 are adapted to produce pulses in the output 22 of the timer-based variable pulse generator 20 having a constant width across the input voltage waveform from a rectified AC input 12, thereby maintaining a good power factor, while still being able to compensate for faster and slower changes in the input voltage to provide a constant load current.

Figure 6:
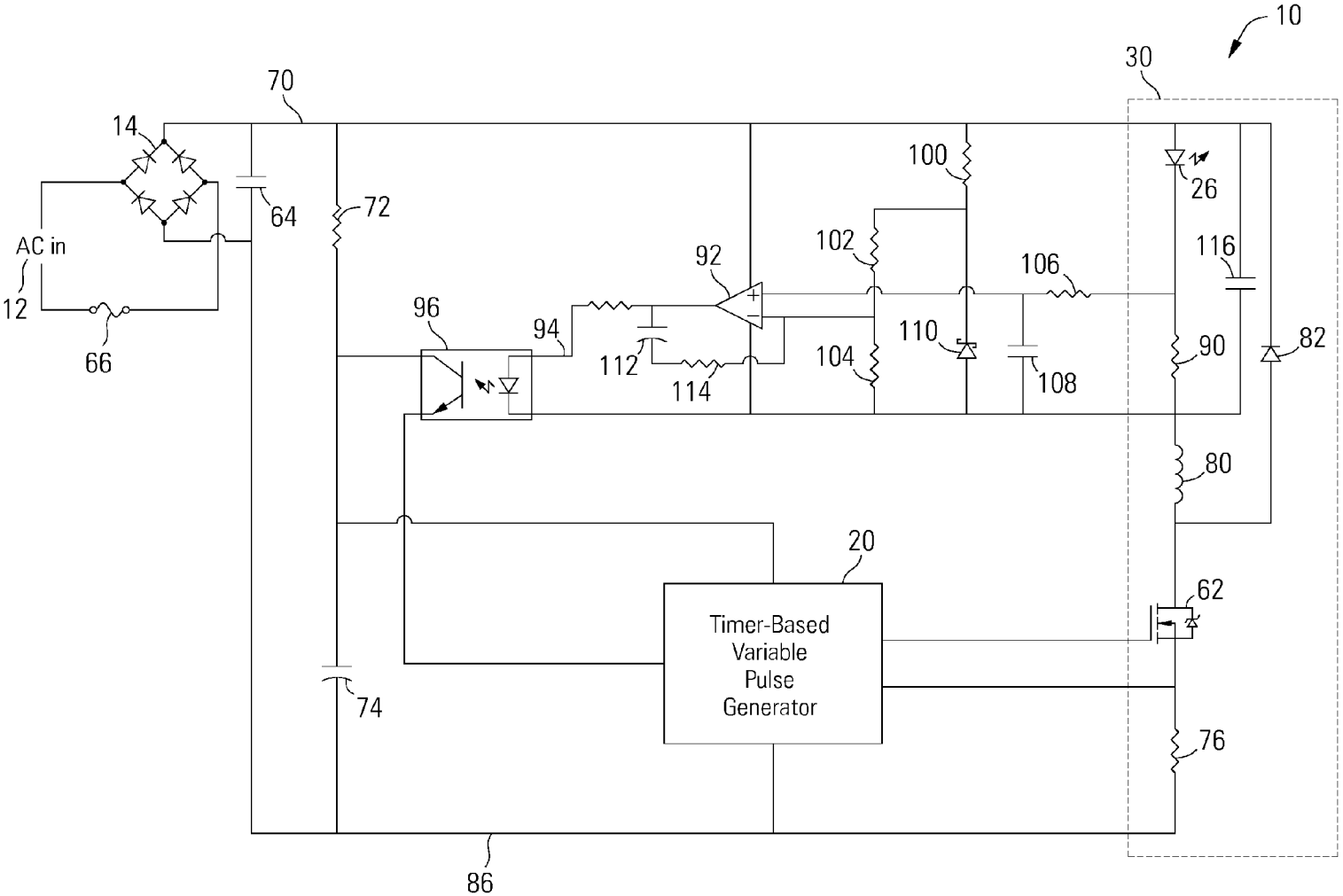
FIG. 6 depicts a block diagram of a timer-based dimmable power supply in accordance with some embodiments.

Referring now to FIG. 6, an example embodiment of the dimmable timer-based power supply 10 may be used to power a load 26 such as one or more LEDs, based on an alternating current (AC) input 12. A dimmable constant current is supplied to the load 26, regulated by a switch such as a transistor 62, under the control of a timer-based variable pulse generator 20. The transistor 62 may be any suitable type of transistor or other device, such as a bipolar transistor or field effect transistor of any type and material including but not limited to metal oxide semiconductor FET (MOSFET), junction FET (JFET), bipolar junction transistor (BJT), heterojunction bipolar transistor (HBT), insulated gate bipolar transistor (IGBT), etc, and can be made of any suitable material including but not limited to silicon, gallium arsenide, gallium nitride, silicon carbide, etc which has a suitably high voltage rating. The AC input 12 is rectified in a rectifier 14 such as a diode bridge and may be conditioned using a capacitor 64. An electromagnetic interference (EMI) filter may be connected to the AC input 14 to reduce interference, and a fuse 66 or similar device or devices may be used to protect the power supply 10 and wiring from excessive current due to short circuits or other fault conditions.

A feedback loop based on the current through the switch 62 causes, as an example but in no way limiting or limited to, the timer-based variable pulse generator 20 to control the switch 62 to adjust the current through the switch 62 and therefore through the load 26. A timer in the timer-based variable pulse generator 20 generates pulses that turn the transistor 62 on and off, and by controlling the timer the load current can be adjusted. The power factor can also be controlled by the timer-based variable pulse generator 20, providing a very high power factor and efficiency.

The timer-based variable pulse generator 20 may be powered by a rectified DC input 70 using a bias supply which may be as simple as a resistor 72 connected between the rectified DC input 70 and the timer-based variable pulse generator 20, and optionally a capacitor 74 to filter out any remaining AC component. In other embodiments, internal components of the dimmable power supply 10 may be powered by other devices such as voltage and/or current regulators from the AC input 12 or rectified DC input 70, or even from other sources.

A sense resistor 76 is placed in series with the switch 62 or in any other suitable location to detect the current through the switch 62 for use in controlling the switch 62. In this embodiment, the timer-based variable pulse generator 20 reads the current through the switch 62 based on the voltage across the sense resistor 76, and reduces or extinguishes the pulses to the gate of the switch 62 if the current is excessive. An inductor 80 and the load 26 are connected in series with the switch 62, and a diode 82 is connected in parallel with the inductor 80 and the load 26. When the transistor 62 is turned on or closed, current flows from the rectified DC input 70 through the load 26 and energy is stored in the inductor 80. When the transistor 62 is turned off, energy stored in the inductor 80 is released through the load 26, with the diode 82 forming a return path for the current through the load 26 and inductor 80. The inductor 80, load 26 and diode 82 thus form a load loop 84 in which current continues to flow briefly when the transistor 62 is off. In some embodiments, the load loop 84 is placed above the switch 62, referenced to rectified DC input 70. In other embodiments, the load loop 84 is placed below the switch 62, referenced to ground 86, or may be referenced to other voltage levels.

A load current sense resistor 90 is connected in series with the load 26 and is used in a feedback loop to control the pulses from the timer-based variable pulse generator 20. (In contrast, the sense resistor 76 provides an input current measurement or average (or peak current depending on the embodiment chosen) load current measurement, including energy stored and released by the inductor 80. Feedback from the load current sense resistor 90 may be provided to the timer-based variable pulse generator 20 to limit or turn off the input current if over-current conditions are detected, such as during periods of high inrush currents. If the load current rises too high, the pulses from the timer-based variable pulse generator 20 will be reduced in any suitable way, for example by reducing the pulse width in a pulse width modulation (PWM) control scheme. This reduces the average on-time of the switch 62 and reduces the load current.

The load current sensed by the load current sense resistor 90 is compared with a reference current level in, for example, an operational amplifier (op-amp) 92 or comparator, with the resulting control signal 94 feeding back to the timer-based variable pulse generator 20. The control signal 94 may be level-shifted or isolated as desired, such as in an opto-isolator 96 or a level-shifting transistor. In other embodiments of the present invention, no level shifting or isolation is/are required.

In the embodiment of FIG. 6, the feedback loop includes, for example, the op-amp 92, with one input connected to a voltage divider (such as resistors 100, 102 and 104) providing a voltage reference, and another input connected to the load current sense resistor 90 to provide a voltage based on the current through the load 26. A series resistor 106 and a shunt capacitor 108 may be connected between the op-amp 92 and the load current sense resistor 90 to add a time constant. A Schottky diode 110 may be connected in parallel with a portion of the voltage divider, such as in parallel with resistors 102 and 104, to protect the op-amp 92 and to set a voltage level of a local ground 120 relative to the rectified DC input 70. A time constant may be added in one or more locations in the feedback loop, such as by a capacitor 112 and resistor 114 in a feedback path around the op-amp 92. The response of the timer-based variable pulse generator 20 to the load current may be controlled by time constants. Time constants may be included in various locations in the feedback loop or in other locations as desired to implement different control schemes or to adjust the response of the dimmable power supply 10. Time constant components may be connected to the local ground 120 as needed, for example if the time constant consists of an RC network with the signal passing through a series resistor and with a shunt capacitor connected to the local ground 120.

Additional components may be included as desired, such as a filtering capacitor 116 connected between the rectified DC input 70 and a local ground 120 used by the feedback circuit. Again, in the embodiment discussed here, the output of the op-amp 92 is fed back to a control input on the variable pulse generator 20, so that the current through the switch 62, referenced to the voltage from the rectified DC input 70, controls the pulse width or overall on-time at the switch 62. The op-amp 92 may in various embodiments comprise a difference amplifier, a summing amplifier, or any other suitable device, component, sub-circuit, circuit, etc. for controlling or creating the variable pulse generator 20 based on the current through the switch 62 and the voltage at the rectified DC input 70.

Figure 7:
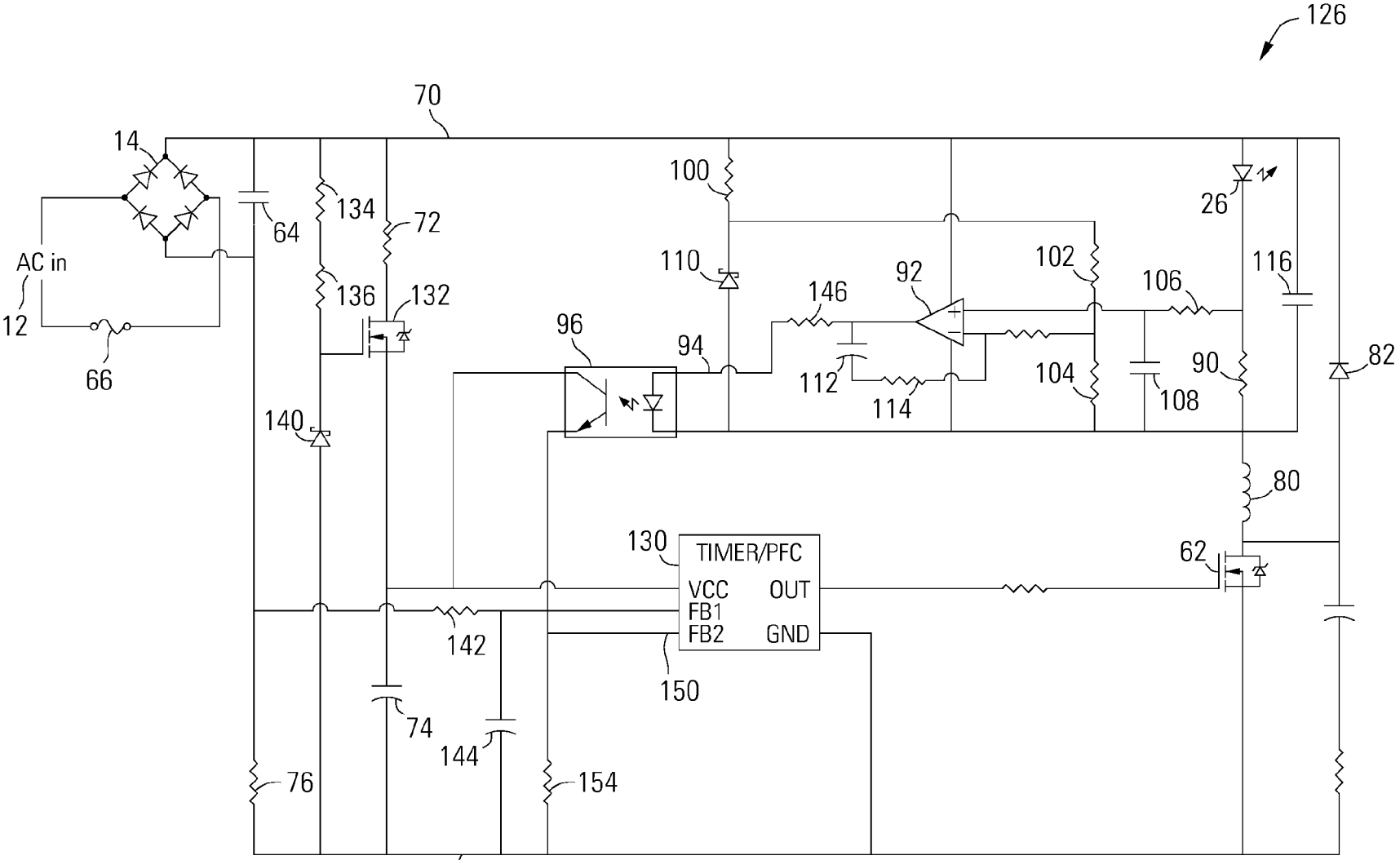
FIG. 7 depicts a block diagram of a timer-based dimmable power supply including a power factor correction circuit in accordance with some embodiments.

Turning now to FIG. 7, in an embodiment of the dimmable power supply 126, the variable pulse generator 20 may be based on a power factor correction circuit 130. The timer-based variable pulse generator 20 is not limited to any particular power factor correction circuit. The term "timer-based variable pulse generator" is thus used herein to refer to circuits based on common timers such as a 555 timer circuit, as well as power factor control circuits which control on-time and off-time of an output signal. The power factor correction circuit 130 is powered by the rectified DC input 70 through a resistor 72 or other bias circuit. In this embodiment, a transistor 132 provides a controlled startup to the power factor correction circuit 130, applying power only after the rectified DC input 70 has risen high enough to pull the gate of the transistor 132 high through one or more resistors (e.g., 134, 136), with the gate voltage limited by a Schottky diode 140. This particular embodiment is merely just one example of a possible bias circuit and other circuits including ones that just contain resistors, capacitors, and possibly diodes are other embodiments that could be used as bias circuits for providing power to the present invention and should not be viewed as limiting or restrictive in any way or form for the present invention.

The power factor correction circuit 130 senses the input current through the sense resistor 76, with an optional time constant applied to the input current sensing. For example, and in no way or form intended to be limiting for the present invention, a series resistor 142 and shunt capacitor 144 may be added to the input current feedback signal.

As with the embodiment of FIG. 6, a control signal 94 is generated based on the current through the load 26, for example measured by a load current sense resistor 90 and referenced to the voltage at the rectified DC input 70. The control signal 94 is fed back to the power factor correction circuit 130 through an optional opto-isolator 96 (and current limiting resistor 146) or other feedback mechanisms, including direct connections. The feedback is connected to the second feedback input 150 of the power factor correction circuit 130 and to ground 86 through resistor 154. The on-time and off-time may thus be controlled by either or both the current through the load 26 and/or the input current through the sense resistor 76. Additional components may be added as desired based on the particular timer circuit or power factor correction circuit 130, setting characteristics such as charge and discharge currents, time constants, scaling factors, etc.

The dimmable power supply 126 may thus use a power factor correction circuit 130 as the timer circuit to control the switch 62 while providing a high power factor, based in various embodiments on load current feedback, input voltage feedback, external control signals such as dimming signals that set reference levels (e.g., the reference voltage to the op-amp 92) or otherwise directly control the on-time of the switch 62, etc. Other embodiments provide these benefits using other timer circuits, such as a 555 timer.

Figure 8:
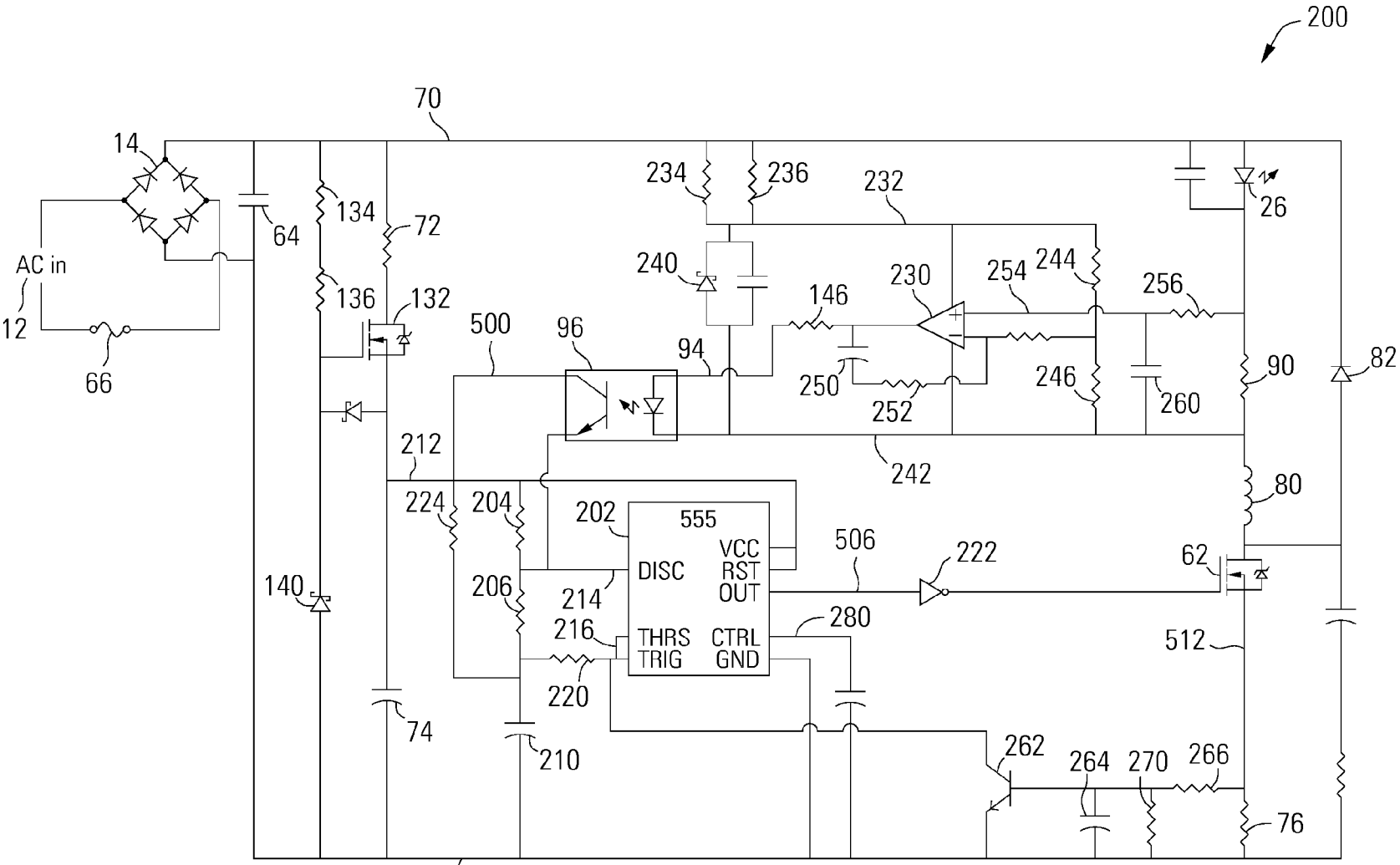
FIG. 8 depicts a block diagram of a timer-based dimmable power supply including a 555 timer in accordance with some embodiments.

Turning now to FIG. 8, an embodiment of the dimmable power supply 200 that includes a 555 timer 202 will be described. In this embodiment, the 555 timer 202 is configured in an astable, free running mode with an on-time set by resistors 204 and 206 and capacitor 210. As in some other embodiments, a local power supply 212 is generated from the rectified DC input 70 by a bias circuit such as a resistor 72 and capacitor 74 or other type of bias circuit, and may be controlled during power-on by a transistor 132. Resistor 204 is connected between the local power supply 212 (Vcc for the 555 timer 202) and the discharge pin 214. Resistor 206 is connected between the discharge pin 214 and the trigger and threshold pins 216 (with an optional small resistor 220 connected between resistor 206 and the trigger and threshold pins 216). Capacitor 210 is connected between resistor 206 and ground 86.

Because the 555 timer 202 generates pulses with an on-time equal or greater to the off-time (for a duty cycle of 50% or greater), an inverter 222 is used to obtain a duty cycle of 50% or less. For current control to be effective at high input voltages, the dimmable power supply 126 should be able to dynamically reduce the duty cycle to a very short pulse width, such as about 1%-5% as a non-limiting example. In the case of the 555 timer 202 in the configuration of FIG. 8, the pulse width and frequency are controlled by changing the values of resistors 204 ($R_R$) and 206 ($R_S$) and a capacitor 210 (C). In this case the pulse width is proportional to $C*(R_R+R_S)$ and frequency is proportional to $1/(C*(R_R+2R_S))$. Because the period is proportional to $C*(R_R+2R_S)$ and the pulse width is proportional to $C*(R_R+R_S)$, changing $R_R$ or $R_S$ will change both the period and pulse width such that a range of about 51%-99% of positive duty cycle can be expected. The inverter 222 inverts the pulses, producing a duty cycle at the switch 62 of about 1%-49%. With the output 506 of the 555 timer 202 inverted, the pulse width is now proportional to $C*R_S$, so that a duty cycle of less than 50% can be achieved. Pulse width is dynamically reduced by activating the opto-isolator 96, effectively lowering the resistance of resistor 206 ($R_S$) and the pulse width.

In other embodiments, a time constant or other undervoltage protection may be included in the power to the inverter 222 so that it does not turn the switch 62 on for long periods during startup while the 555 timer 202 is not oscillating and the output from the 555 timer 202 is constantly low. In yet other embodiments, other logic elements may be used in place of the inverter 222 to reduce the duty cycle at the switch 62. For example, the inverter 222 may be replaced with a NAND gate with an input connected to the 555 timer 202 and another input connected to a startup signal. Other embodiments include, but are in no way limiting or restrictive for the present invention, NOR, NAND, AND, OR, exclusive OR (XOR and EXOR), and other types of digital logic and electronics, field programmable gate arrays (FPGAs), application specific integrated circuits (ASICs), microcontrollers, microprocessors, etc.

To reduce the pulse width at the switch 62, the value of resistor 206 is reduced by connecting resistor 224 in parallel with resistor 206 through, for example in this particular embodiment, the opto-isolator 96. The opto-isolator 96 is operated in analog fashion by the control signal 94, ranging from a very high resistance to about 1 kΩ when fully on. The dimmable power supply 200 may be configured to turn the pulse at the switch 62 almost fully off when the control signal 94 fully turns on the opto-isolator 96, reducing the resistance between the discharge pin 214 and trigger and threshold pins 216 of the 555 timer 202. MOSFET, bipolar or other types or transistors, switches and transformers, etc. can be used to also perform this type of function in the present invention.

In other embodiments, resistor 206 may be replaced with a programmable resistor such as a digital resistor. In these embodiments, the pulse width is controlled by adjusting the programmable resistor, either using the feedback circuit including the op-amp 92, or directly from user input. For example, a programmable resistor may be used to dim the load 26 by programming the programmable resistor, for example using a remote control, cellular telephone, etc. In still other embodiments, a current source or programmable current source can also be used. In addition, variable resistors, potentiometers, variable capacitors, and other active and passive devices, circuits, components, etc. may be used.

For the embodiment shown, the control signal 94 in the dimmable power supply 200 is generated by an op-amp 230 based on the current through the load 26, measured by the load current sense resistor 90, and based on the voltage at the rectified DC input 70. The op-amp 230 is powered by a local voltage source 232, generated from the rectified DC input 70 by a bias supply such as one or more resistors 234 and 236 and a Schottky diode 240 connected between the rectified DC input 70 and a local ground 242. The op-amp 230 compares the load current, measured by load current sense resistor 90, with a reference voltage based on the rectified DC input 70 to generate the control signal 94. The reference voltage in the embodiment of FIG. 8 is based on the local voltage source 232, divided by voltage divider resistors 244 and 246. One or more time constants may be applied in various locations, for example to filter, for example, 50 Hz, 60 Hz, 100 Hz or 120 Hz components in the load current, such as in the feedback loop of the op-amp 230 using a capacitor 250 and resistor 252, or at the load current input 254 of the op-amp 230 using a series resistor 256 and shunt capacitor 260. Before the load current limit is met, the output of op-amp 230 is essentially off and the on-time of the 555 timer 202 is set by resistors 204 and 206 and capacitor 210. After the load current limit is met, the feedback circuit is applied, reducing the resistance across resistor 206. As the load current rises, the control signal 94 is turned on in analog fashion, turning on the opto-isolator 96 and applying the resistor 224 in parallel with resistor 206, which increases the on-time of the 555 timer 202 and decreases the on-time of the inverted pulses at the switch 62. This decreases the average input current, reducing the current through the load 26 until the appropriate current level is attained.

The average and/or instantaneous input current may also be monitored and used to limit the on-time of the switch 62. For example, sense resistor 76 is used in the embodiment of FIG. 8 to turn on bipolar junction transistor 262 when the input current exceeds a threshold value, shorting across the capacitor 210 and preventing the 555 timer 202 from oscillating. A time constant may be applied to the input current measurement, for example with capacitor 264 and resistor 266. The threshold value is set in part by the value of the sense resistor 76 and the cut-in voltage of the transistor 262, and may be further manipulated by components such as voltage dividing resistor 270. In some embodiments, the dimmable power supply 200 operates based on input current feedback from the sense resistor 76, without feedback from the load current. In these embodiments, the feedback circuit including the load current sense resistor 90 and op-amp 230 may be omitted. The bipolar junction transistor 262 may also be replaced with any other type of transistor, switch, transformer, etc. that performs this type of function.

The frequency of the switch 62 may be dithered to spread noise from the dimmable power supply 200, thereby reducing EMI at a single frequency. Dither can help to meet EMI requirements. Operating at a rigid frequency creates a sharp "spike" on EMI plots at the operating frequency and harmonics of the operating frequency, which may exceed regulatory limits. By "dithering" the frequency the peak amplitudes on the EMI plot are lower and use a broader range of frequencies. In some embodiments, dithering may be accomplished by varying the astable frequency at which the 555 timer 202 oscillates. For example, this may be accomplished by changing or modulating the control voltage at the CTRL terminal 280 of the 555 timer 202. The control voltage may be modulated in any suitable manner, such as with another 555 timer, a noise generator, or any other suitable circuit to vary the control voltage at the CTRL terminal 280. The oscillation frequency of the 555 timer 202 can thus be varied somewhat to dither the frequency of the switch 62 enough to reduce noise while maintaining current control and a high power factor. Dithering or other noise reduction techniques are not limited to the examples presented herein and can include, for example, ones based on microcontrollers, microprocessors, FPGAs, digital logic, digital and analog electronics, etc. Again, these are just examples of dithering and noise reduction and the present invention is not limited to the examples presented herein. If the feedback loop provides a signal that is not purely DC (e.g. has some AC component, whether deliberate or unintentional), some degree of dither will be observed.

Figure 9:
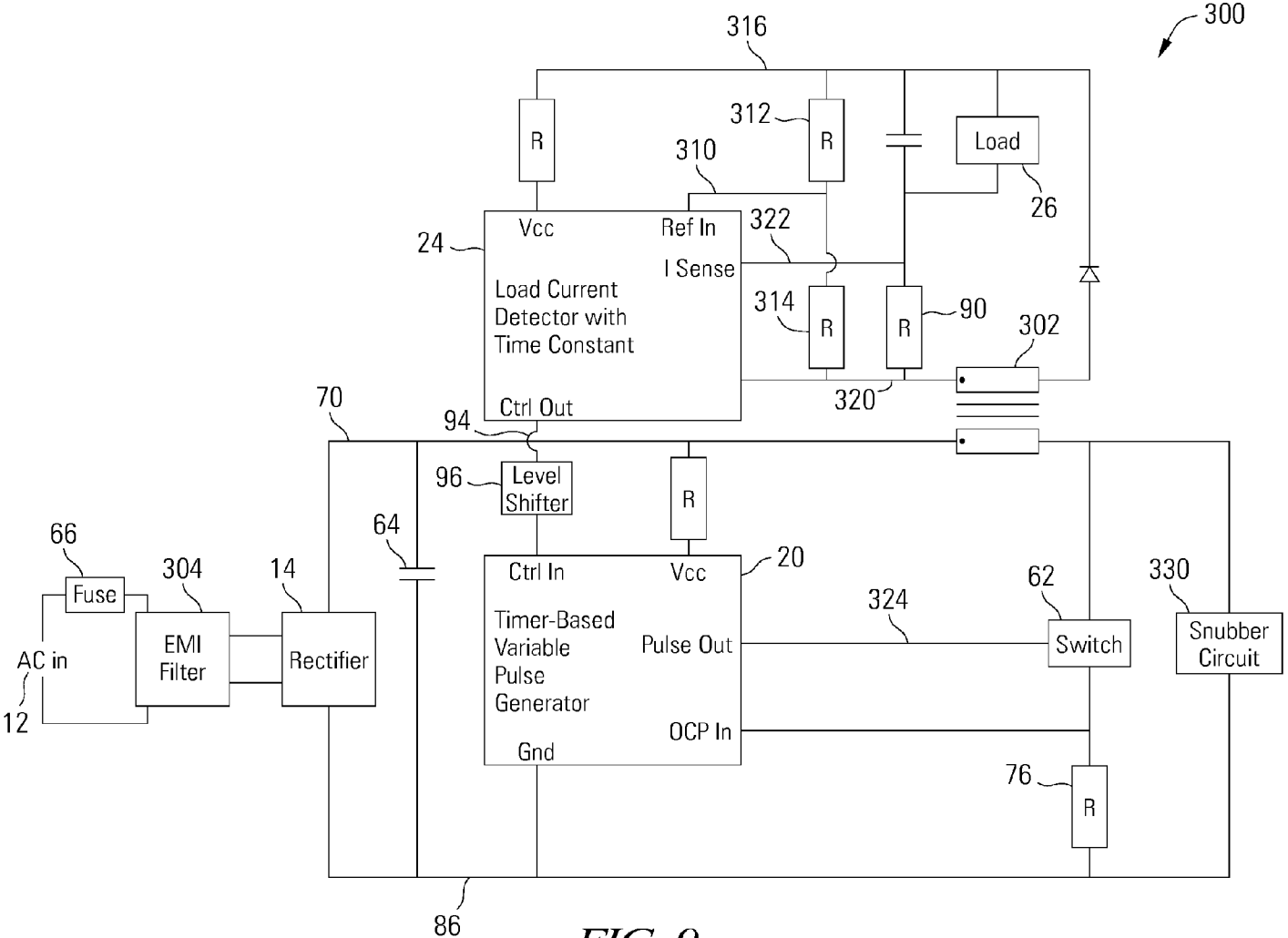
FIG. 9 depicts a block diagram of a timer-based dimmable power supply including an isolation transformer in flyback mode in accordance with some embodiments.

Turning now to FIG. 9, an embodiment of a timer-based dimmable power supply 300 may include a transformer 302 in the flyback mode of operation to provide isolation between the AC input 12 and the load 26. The AC input 12 is connected to the dimmable power supply 300 in this embodiment through a fuse 66 and an electromagnetic interference (EMI) filter 304. As in previously described embodiments, the fuse 66 may be any device suitable to protect the dimmable power supply 300 from overvoltage or overcurrent conditions. The AC input 12 is rectified in a rectifier 14. In other embodiments, the dimmable power supply 300 may use a DC input. The dimmable power supply 300 is generally divided into a high side portion including a load current detector 24 and a low side portion including the timer-based variable pulse generator 20. The high side portion is connected to one side of the transformer 302, such as the secondary winding, and the low side portion is connected to the other side of the transformer 302, such as the primary winding. A level shifter such as opto-isolator 96 is employed between the load current detector 24 in the high side and the timer-based variable pulse generator 20 in the low side to communicate the control signal 94 to the timer-based variable pulse generator 20. The load 26 is powered from the AC input 12 through the rectifier 14 and the transformer 302, with the current regulated by the switch 62. A current reference signal 310 is generated for the load current detector 24 by a voltage divider having resistors 312 and 314 connected in series between the power input 316 and a high side or local ground 320.

In the high side portion, as current flows through the load 26, the load current sense resistor 90 provides a load current feedback signal 322 to the load current detector 24. The load current detector 24 compares the current reference signal 310 with the load current feedback signal 322, and generates the control signal 94 to the variable pulse generator 20. A time constant is applied in some embodiments to the current reference signal 310 and/or the load current feedback signal 322, or in any other suitable locations, to effectively average out and disregard current fluctuations due to any waveform at the power input 316 and pulses from the timer-based variable pulse generator 20 through the transformer 302. The timer-based variable pulse generator 20 adjusts the pulse width of a train of pulses at the pulse output 324 of the variable pulse generator 20 based on the level shifted control signal 94 from the load current detector 24. The opto-isolator 96 shifts the control signal 94 from the load current detector 24 which is referenced to the local ground 320 by the load current detector 24, referencing it to a level appropriate to use by the timer-based variable pulse generator 20. Again, the level shifter may comprise any suitable device for shifting the voltage of the control signal 94 between isolated circuit sections, such as an opto-isolator, opto-coupler, resistor, transformer, etc. In other embodiments, the control signal 94 or ground nodes or other reference voltage nodes may be connected between the high side and low side of the dimmable power supply 300, tying them together and avoiding the need for a level shifter.

A snubber circuit 330 may be included, for example, with the switch 62 if desired to suppress transient voltages in the low side circuit. It is important to note that the dimmable power supply 300 is not limited to the flyback mode configuration illustrated in FIG. 9, and that a transformer- or inductor-based dimmable power supply 300 may be arranged in any desired topology including, for example, but not limited to a forward transformer configuration. The present invention is not limited to any particular topology or control scheme and can be generally applied to single and multiple stage topologies including but not limited to constant on time, constant off time, constant, frequency, variable frequency, variable duration, discontinuous, continuous, critical conduction modes of operation, CUK, SEPIC, boost-buck, buck-boost, buck, boost, forward, flyback, etc. and any combination of these and other circuit topologies.

Figure 10:
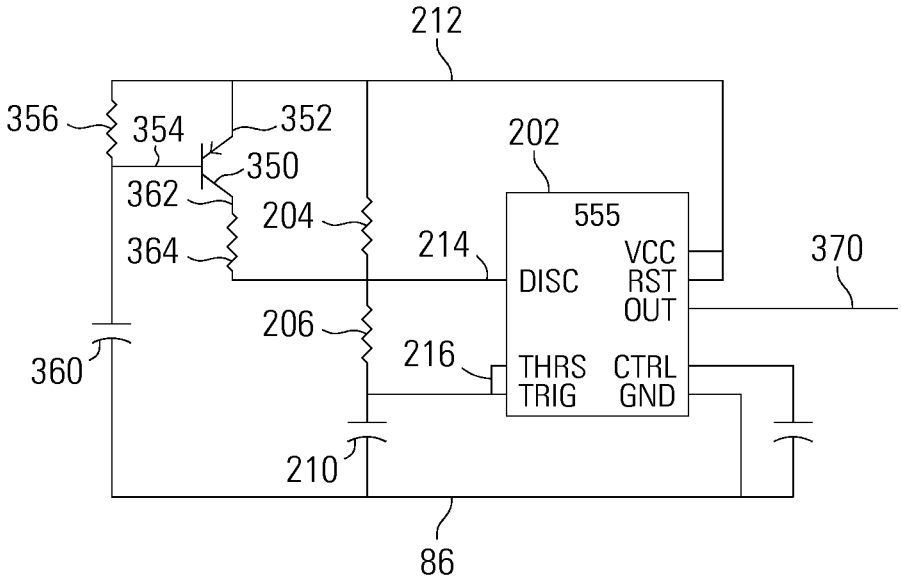
FIG. 10 depicts a block diagram of a 555 timer and pulse control circuitry in accordance with some embodiments.

Turning now to FIG. 10, input current through the switch 62 may be limited during startup of the dimmable power supply 200 using a transistor 350 in conjunction with the 555 timer 202. For example, the transistor 350 may comprise a PNP bipolar junction transistor (BJT). The emitter 352 is connected to the local power supply 212. The base 354 is connected to the local power supply 212 through a resistor 356 and to the ground 86 through a capacitor 360. The collector 362 is connected to the discharge pin 214 of the 555 timer 202 through a resistor 364. When the local power supply 212 first powers up, a current will flow through resistor 356, charging the capacitor 360. This creates a positive $V_{EB}$ at the base 354 of the transistor 350, turning it on and connecting resistor 364 in parallel with resistor 204. This reduces the overall resistance between the local power supply 212 and the discharge pin 214 of the 555 timer 202, reducing the pulse width at the output 370 during startup, controlling the inrush current through the switch 62 to protect it. As time goes on and the capacitor 360 charges up, the current through the resistor 356 stops and the $V_{EB}$ at the base 354 of the transistor 350 falls, turning off the transistor 350 and disconnecting the resistor 364.

Other configurations may be used to modify the duty cycle of the pulses on the output 370 that is connected to the gate of the switch 62 and the behavior of the 555 timer 202. For example, in some another embodiments, the resistor 356 and capacitor 360 are swapped. In yet another embodiments, the resistor 364 is connected across the emitter 352 and collector 362 of the transistor 350, shorting out the resistor 364 when the transistor 350 is turned on.

Figure 11:
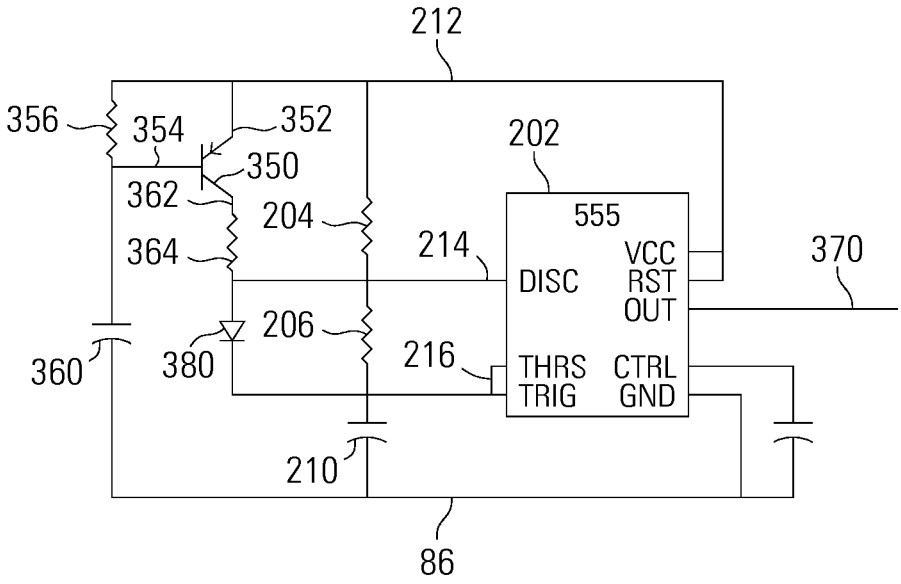
FIG. 11 depicts a block diagram of a 555 timer and pulse control circuitry in accordance with some embodiments.

In another embodiment illustrated in FIG. 11, a duty cycle of 50% or less is obtained from the 555 timer 202 without the need for an inverter 222, by connecting a diode 380 between the discharge pin 214 and trigger and threshold pins 216 of the 555 timer 202, with the anode at the discharge pin 214. The charging path of the capacitor 210 is through resistor 204 and the diode 380, while the discharge path is through resistor 206 to the discharge pin 214 of the local power supply 212.

Diode 380 changes the time constant equations such that the pulse width is proportional to $C*R_R$ and the period is proportional to $C*(R_R+R_S)$. With this configuration, a duty cycle range of 1%-99% is reasonable and the inverter 222 is not needed. Control of the 555 timer 202 in the embodiment of FIG. 11 is achieved by lowering the effective resistance of resistor 204 ($R_R$) by activating transistor 350, lowering the pulse width. Note that in this embodiment, the output terminals of the opto-isolator 96, if utilized in this embodiment, need not be floating as in the embodiment of FIG. 8. By including the diode 380, the opto-isolator 96 can be connected across the resistor 204 rather than across the resistor 206, thus tying one terminal of the opto-isolator 96 (or other circuit element which could perform a similar function such as a transistor or switch, etc.) to the local power supply 212.

In another embodiment, a pair of 555 timers may be used, one to set a base frequency and the other capacitively coupled to the first to vary the duty cycle. (For example, a 556 dual 555 timer chip could be used to provide the two 555 timers.) The first timer is configured as an astable multi-vibrator running at the fundamental frequency. The second is configured in a monostable one-shot mode, which generates a pulse of a set width each cycle. The control method for this dual timer setup involves simply changing the switching threshold of the second 555 timer.

Figure 12:
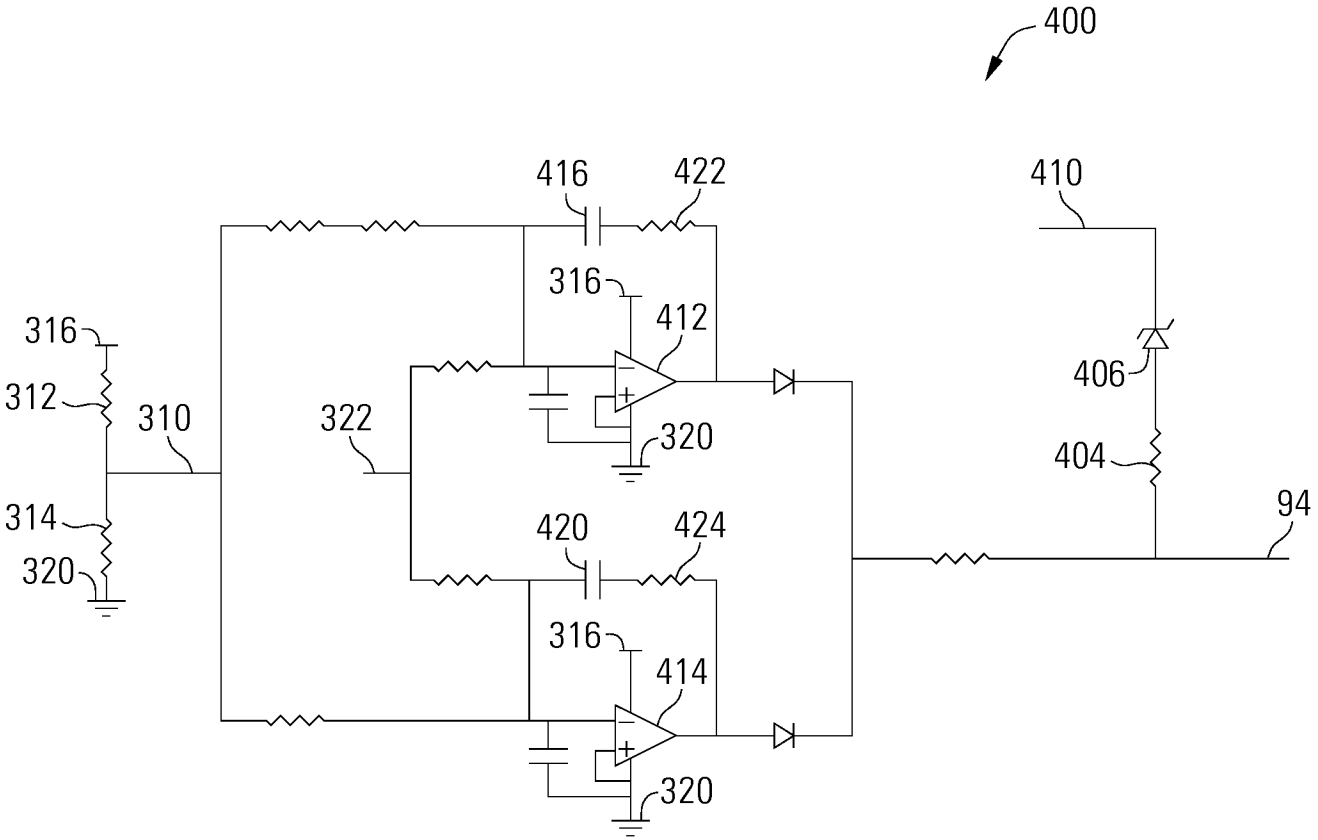
FIG. 12 depicts a block diagram of a dither control circuit for a timer-based dimmable power supply in accordance with some embodiments.

Turning now to FIG. 12, in some embodiments a feedback circuit 400 with multiple time constants is used to control transients as well as to control the current through the load 26. The feedback circuit 400 illustrated in FIG. 12 may be used to produce the control signal 94 to the timer-based variable pulse generator (e.g., 20, 130, and 202), based on the load current feedback signal 322. The feedback circuit 400 is shown as it may be applied to the dimmable power supply 300 of FIG. 9, although it is not limited to that embodiment and may be used in the dimmable power supplies 10 and 200 and in any other embodiments desired. The feedback circuit 400 produces a control signal 94 based on the load current feedback signal 322 using at least two time constants, to enable the feedback circuit 400 to clamp down on transient spikes, overshoot, etc. in the current through the load 26 as well as to provide normal operating control of the current through the load 26. In some embodiments, the frequency of the pulses from the timer-based variable pulse generator (e.g., 20, 130, and 202) is varied to reduce electromagnetic interference (EMI). This reduction in EMI may be accomplished by varying the on and off time of the timer-based variable pulse generator 20 enough to spread the spectrum of the output. As an example, by applying a time-varying voltage to the control pin 402 of the timer-based variable pulse generator 20 that changes the frequency, some dither can be produced in the circuit. The dimmable power supply may also include some natural dither if it is not set to hold the frequency constant from the timer-based variable pulse generator.

Overvoltage protection may be included using a resistor 404 and one or more Zener diodes 406, for example when using a dimmable power supply with a transformer connected in flyback mode. A flyback feedback signal 410 is connected to the control signal 94 through the resistor 404 and Zener diode 406, and if the flyback feedback signal 410 reaches the breakdown voltage of the Zener diode 406, the control signal 94 will be pulled up and shorten or turn off the pulses from the timer-based variable pulse generator 20.

In the feedback circuit 400, the load current feedback signal 322 and the current reference signal 310 are compared in two or more op-amps 412 and 414, each with a different time constant. In one embodiment illustrated in FIG. 12, the different time constants are produced using different values of capacitors 416 and 420 and/or resistors 422 and 424 in the op-amp feedback paths. As the feedback signals with different time constants are combined in the control signal 94, the control signal 94 reacts both to fast and slow changes in the current through the load 26.

Figure 13:
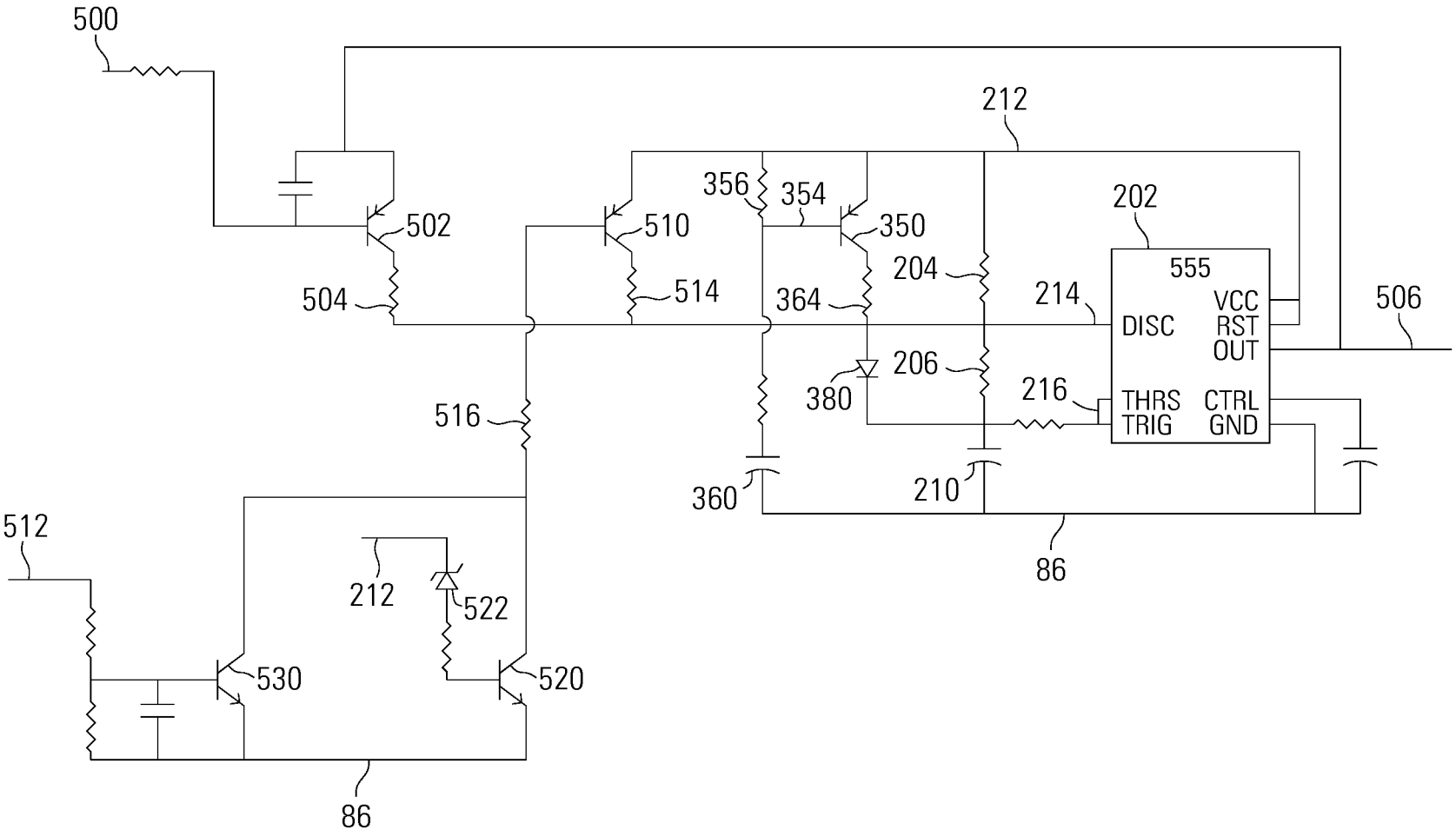
FIG. 13 depicts a block diagram of a 555 timer with multiple pulse control signals in accordance with some embodiments.

Turning now to FIG. 13, some embodiments of the timer-based dimmable power supply including a 555 timer 202 have multiple feedback controls. Some of these feedback controls that may be included in any of the embodiments herein or variations thereof will be described as they may be included in the embodiment of FIG. 8, although they are not limited to that embodiment and may be included individually or collectively in any embodiments. A soft start transistor 350 may be included to limit the pulses from the 555 timer 202 when the 555 timer 202 is first powering up, as in FIGS. 10 and 11. The startup period during which the on-time is limited or reduced by the soft start transistor 350 may be set, for example, by the cut-in voltage of the soft start transistor 350 and by voltage dividing resistors and/or other components connected to the soft start transistor 350. Although a bipolar transistor is illustrated in the FIG. 13, any type of transistor including but not limited to BJTs, MOSFETs, HBTs, unijunction transistors, junction FETs (JFETs), metal semiconductor FETs (MESFETs), IGBTs, heterojunction FETs, etc. made of any material or materials including, but not limited to, silicon (Si), silicon carbide, silicon germanium (SiGe), (SiC), gallium nitride (GaN), gallium arsenide (GaAs), indium phosphide, silicon on insulator (SOI), etc. based materials. The opto-isolator 96 may be used to apply a parallel resistor 224 across resistor 204 directly as in FIG. 8 to shorten the pulse on-time, or alternatively, as illustrated in FIG. 13, the shifted load current feedback signal 500 from the opto-isolator 96 may be used control a transistor 502. When turned on, the transistor 502 pulls up the discharge pin 214 through resistor 504. Transistors, switches, transformers, diodes, operational amplifiers, comparators, digital and logic circuits, components, FPGA, microcontrollers, microprocessors, etc. and other components may be used to perform the function of the opto-isolator in different embodiments of the present invention.

Various power conservation techniques may be applied in some embodiments. For example, as illustrated in FIG. 13, transistor 502 is powered by the pulse output 506 from the 555 timer 202, so it draws power only during the pulse on-time. This connects resistor 504 in parallel with resistor 204 (as controlled by the shifted load current feedback signal 500) only during the on-time of the pulse when it would be useful to shorten the on-time of the pulse. (Note that the 555 timer 202, as configured in FIG. 13, does not need the inverter 222 due to the diode 380.) Various other power conservation techniques may be included as desired.

One or more transistors (e.g., 510) may be used to apply control signals based on the voltage level of the local power supply 212 and on the input current 512, either singly or combined as in FIG. 13. The transistor 510, when turned on, pulls up the discharge pin 214 through a small resistor 514. In this example, transistor 510 is a PNP BJT that turns on when the base is pulled down through resistor 516. An NPN BJT transistor 520 turns on the transistor 510 when the local power supply 212 rises above the breakdown voltage of a Zener diode 522. Another NPN BJT transistor 530 turns on the transistor 510 when the input current 512 rises above a threshold. Other control schemes may be applied to the pulses as desired. Other schemes include, but are not limited to in any way or form, digital logic, digital and/or analog electronics, microprocessor, microcontrollers, FPGAs, ASICs, etc. Such control schemes and approaches can also be combined, for example, into an integrated circuit, etc.

Figure 14:
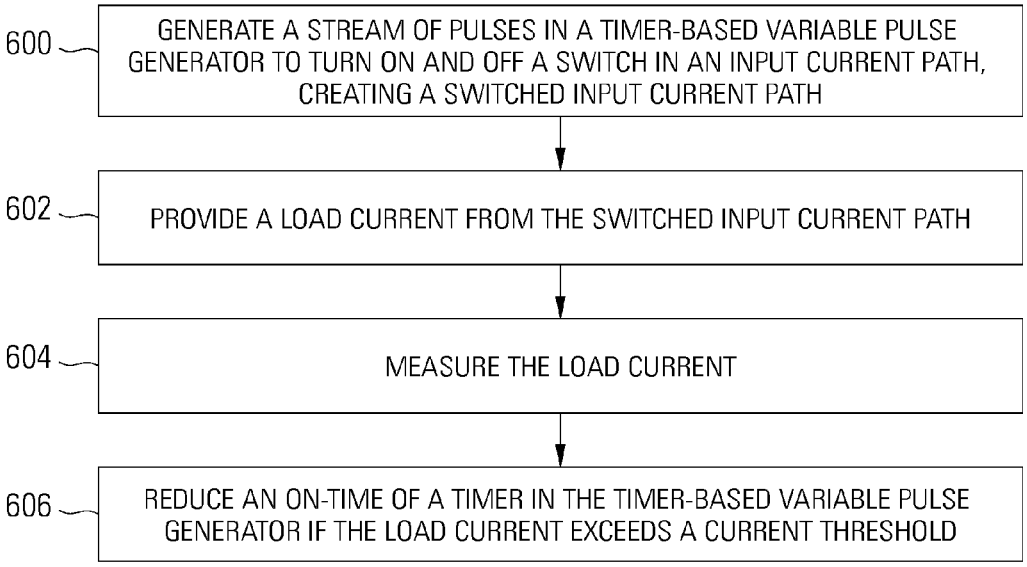
FIG. 14 depicts a flow chart of an example method for controlling a load current in accordance with some embodiments.

An example method of controlling a load current is illustrated in FIG. 14. A stream of pulses is generated in a timer-based variable pulse generator to turn on and off a switch in an input current path, creating a switched input current path. (Block 600) A load current is provided from the switched input current path, for example through a transformer as in the embodiment of FIG. 9, or directly in the input current path, as in the embodiment of FIG. 8. (Block 602) The load current is measured (block 604), for example using a sense resistor and op-amp to compare the voltage across the sense resistor with a reference voltage, either fixed or dynamic as in embodiments described herein and variations thereof. The on-time of a timer in the timer-based variable pulse generator is reduced if the load current exceeds a current threshold. (Block 606) As an example, the sense resistor could be replaced with a sense transformer or a Hall effect sense element, etc. In addition, for example, the output from the 555 time or equivalent or the output from the inverter to the transistor/switch can be used in conjunction with a drive transformer to supply the signals (e.g., turn-on and turn-off) to, for example, the gate and/or base of the switch/transistor/etc. or the switches/transistors/etc.

The present invention can be used for power supplies and drivers other than LEDs including, but not limited to, fluorescent lamps (Fls) and other lighting and general power supply uses and is not limited in any way or form.

While illustrative embodiments have been described in detail herein, it is to be understood that the concepts disclosed herein may be otherwise variously embodied and employed.

What is claimed is:

1. A dimmable power supply comprising:

an input current path;

a switch in the input current path;

an energy storage device connected to the input current path;

a load output connected to the energy storage device; and a timer-based variable pulse generator connected to a control input of the switch, the timer-based variable pulse generator being adapted to generate a stream of pulses having a variable on-time and off-time, wherein the dimmable power supply is adapted to vary the on-time and off-time to control a current at the load output, wherein the timer-based variable pulse generator comprises a power factor correction circuit.

2. The dimmable power supply of claim 1, wherein the timer-based variable pulse generator comprises a 555 timer circuit.

3. The dimmable power supply of claim 1, wherein the on-time of the pulses is controlled at least in part based on the current at the load output.

4. The dimmable power supply of claim 1, further comprising a bias power supply, wherein the timer-based variable pulse generator is powered by the bias power supply, and wherein the on-time of the pulses is controlled at least in part based on a voltage level from the bias power supply.

5. The dimmable power supply of claim 1, wherein the on-time of the pulses is controlled based on a plurality of control signals, the plurality of control signals comprising an indication of input current level, an indication of the current at the load output, and an indication of a voltage level of a bias power supply powering the timer-based variable pulse generator.

6. The dimmable power supply of claim 2, further comprising an inverter connected between the 555 timer circuit and the switch.

7. The dimmable power supply of claim 2, wherein the on-time is controlled at least in part on a value of an external resistor connected to the 555 timer circuit.

8. The dimmable power supply of claim 7, wherein the value of the external resistor is changed using a transistor.

9. The dimmable power supply of claim 8, wherein the transistor is powered only during the on-time.

10. The dimmable power supply of claim 7, wherein the value of the external resistor is changed by connecting a second resistor in parallel with the resistor.

11. The dimmable power supply of claim 7, wherein the external resistor comprises a programmable resistor, and wherein the value of the external resistor is changed by changing a state of the programmable resistor.

12. The dimmable power supply of claim 2, further comprising a soft start circuit connected to the 555 timer, wherein the soft start circuit is adapted to reduce the on-time during a startup period of the 555 timer.

13. The dimmable power supply of claim 12, wherein the soft start circuit comprises a transistor turned on based on a voltage of a bias power supply that powers the 555 timer, wherein the transistor adjusts an external resistance to set the on-time of the 555 timer.

14. The dimmable power supply of claim 1, wherein power consumption is reduced by powering at least one active circuit element loop in a feedback loop only during the on-time.

15. The dimmable power supply of claim 1, further comprising a load current feedback circuit connected between the load output and the timer-based variable pulse generator to control the on-time, the load current feedback circuit comprising a plurality of time constants.

16. The dimmable power supply of claim 2, further comprising a diode connected between a pair of terminals on the 555 timer, thereby providing different charging and discharging paths for the 555 timer to produce a duty cycle of less than about 50%.

17. The dimmable power supply of claim 15, wherein the load current feedback circuit comprises a plurality of operational amplifiers, each connected to the load output and to a reference voltage, each having a different time constant.

18. A dimmable power supply comprising:

an input current path;

a switch in the input current path;

an energy storage device connected to the input current path;

a load output connected to the energy storage device; and a timer-based variable pulse generator connected to a control input of the switch, the timer-based variable pulse generator being adapted to generate a stream of pulses having a variable on-time and off-time, wherein the dimmable power supply is adapted to vary the on-time and off-time to control a current at the load output, wherein the timer-based variable pulse generator comprises a 555 timer circuit.

19. A dimmable power supply comprising:

an input current path;

a switch in the input current path;

an energy storage device connected to the input current path;

a load output connected to the energy storage device;

a timer-based variable pulse generator connected to a control input of the switch, the timer-based variable pulse generator being adapted to generate a stream of pulses having a variable on-time and off-time, wherein the dimmable power supply is adapted to vary the on-time and off-time to control a current at the load output; and a load current feedback circuit connected between the load output and the timer-based variable pulse generator to control the on-time, the load current feedback circuit comprising a plurality of time constants.

* * * * *